US005752320A

United States Patent [19]

Otte et al.

[11] Patent Number: 5,752,320

[45] Date of Patent: May 19, 1998

[54] BOREHOLE DIP INSTRUMENT

[75] Inventors: Hubert Josef Otte, Toronto; Lennart Roosman, Etobicoke; John Emanuel Paulson, Toronto, all of Canada

[73] Assignee: Borehole Survey Systems Inc., Toronto, Canada

[21] Appl. No.: 701,509

[22] Filed: Aug. 22, 1996

[51] Int. Cl.[6] ..... E21B 47/022

[52] U.S. Cl. ..... 33/304; 33/308; 33/391; 33/399

[58] Field of Search ..... 33/304, 1 H, 308, 33/309, 311, 312, 313, 391, 392, 398, 399, 401, 542, 544

[56] References Cited

U.S. PATENT DOCUMENTS

| | | | |
|---|---|---|---|
| 1,845,889 | 2/1932 | Schoolcraft | 33/304 |
| 1,987,696 | 1/1935 | McLaughlin et al. | 33/304 |
| 2,412,976 | 12/1946 | Emerson et al. | 33/309 |
| 2,563,359 | 8/1951 | Peebles | 33/311 |
| 2,648,141 | 8/1953 | Hildebrandt | 33/304 |
| 2,706,860 | 4/1955 | Suter | 33/311 |
| 4,071,959 | 2/1978 | Russell et al. | 33/313 |
| 4,587,871 | 5/1986 | Kathel | 33/304 |
| 5,634,280 | 6/1997 | Hellier et al. | 33/556 |

FOREIGN PATENT DOCUMENTS

| | | | |
|---|---|---|---|
| 1502816 | 8/1989 | U.S.S.R. | 33/304 |

*Primary Examiner*—Christopher W. Fulton

[57] ABSTRACT

A dip angle indicator for use in boreholes, and having, an elongated casing, having a diameter to fit down a desired borehole, a sensing chamber, located along the central axis of the casing and defining first and second ends, a linear variable displacement transducer, located along the central axis, and having an operating rod with a free end positioned in the sensing chamber, the rod free end defining a generally conical point, a swing arm located within the sensing chamber, along the central axis, and having a free end defining a generally conical recess, the conical recess receiving the conical point of the transducer rod, movable mounting means mounting the swing arm at one end of the sensing chamber, remote from the transducer, the swing arm extending through the moveable mounting means outside of the chamber, and, weight means mounted on the free end of the swing arm outside the chamber, the weight means being free to move within the casing, whereby to tilt the swing arm within the chamber, and thereby apply axial force to the transducer rod.

7 Claims, 3 Drawing Sheets

FIG. 4
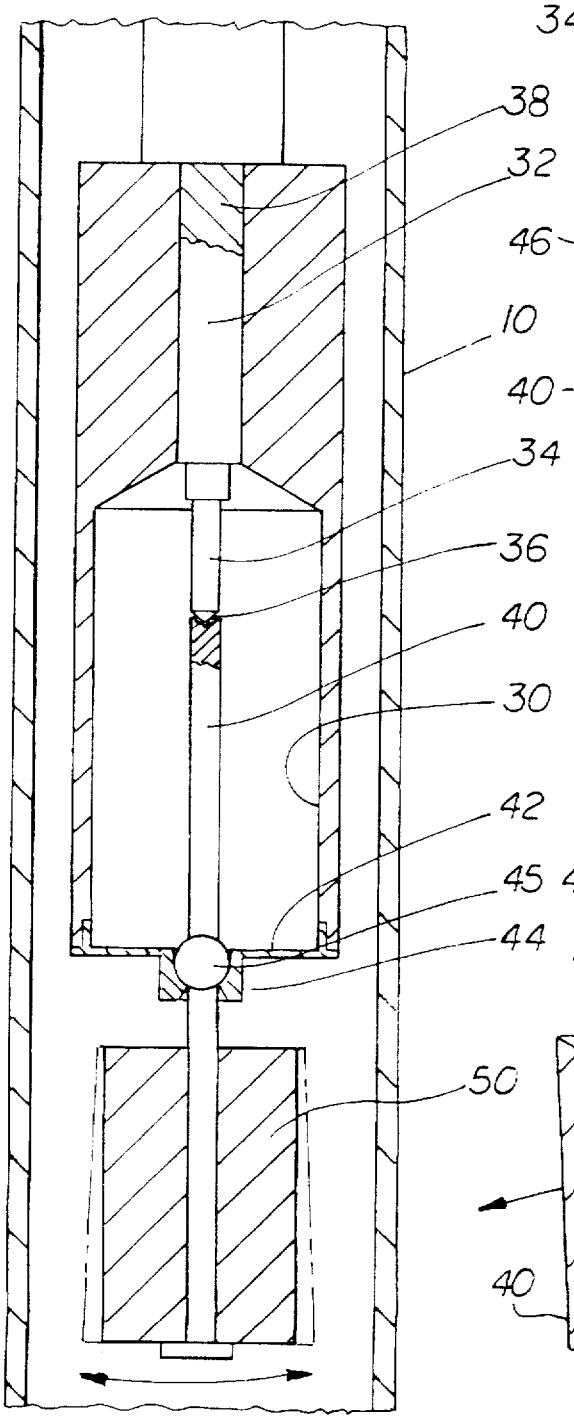
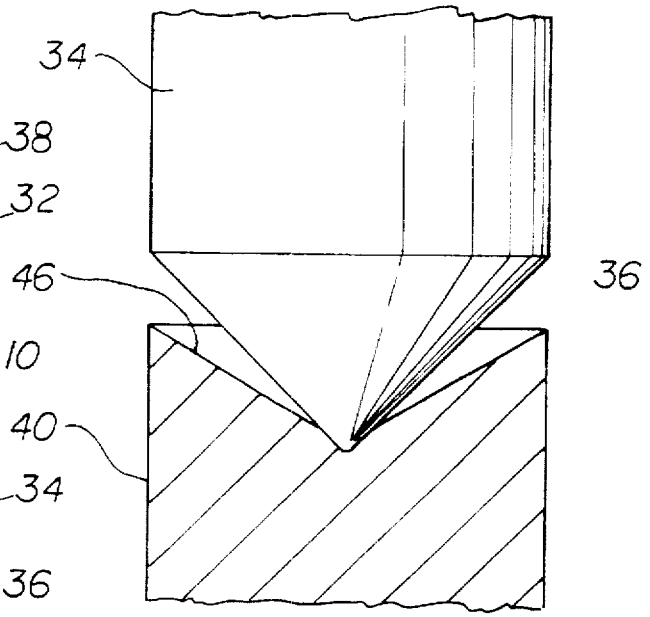
FIG. 5
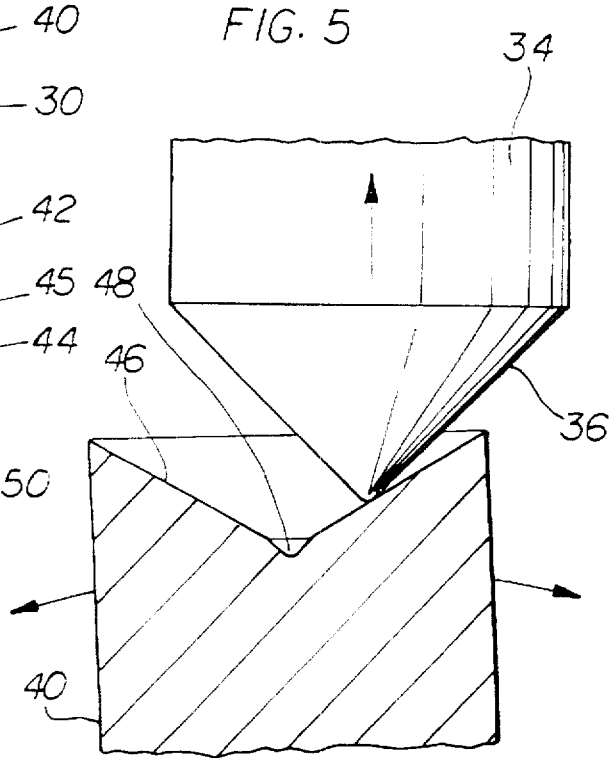
FIG. 6

BOREHOLE DIP INSTRUMENT

FIELD OF THE INVENTION

The invention relates to borehole instruments, and particular, to an instrument for indicating the dip angle of a borehole.

BACKGROUND OF THE INVENTION

When drilling a borehole into a substrate in the earth's surface, it is well known that the drill bit will not drill a perfectly straight borehole. As it gets deeper into the earth's surface, and as it encounters different types of strata, the bit will tend to wander, and may eventually adopt an angular orientation which is significantly different from that intended.

It will of course be appreciated that boreholes may be drilled straight down into the earth, or in many cases, may be drilled at an intended off vertical angle.

After the bit has descended thousands of feet, it is essential to know the degree of variation between the actual angle of the borehole and the intended angle.

It has been the practice for a great many years to carry out measurements using what is known as an "acid etch" process.

In this process acid is placed in a glass vessel which is lowered down into the borehole a predetermined distance. The glass vessel is then allowed to remain there for a predetermined length of time, allowing the acid to etch a ring around the glass vessel.

The glass vessel is then removed. The angle of the ring relative to the central axis of the glass vessel will then give the angle of the borehole.

This process is of course extremely slow. It is also liable to many errors. The glass vessel may not lie precisely true in the borehole. The glass vessel may be broken during insertion or retrieval. For many reasons the process is regarded as at best a somewhat unreliable estimate.

Numerous proposals have been made over the past to provide electrical measuring instruments for measuring the dip angle. These instruments in some cases depend on the operation of a gyroscope. In other cases they operate simply on the principle of a pendulum. One instrument in fact operated using photographic paper, and a light beam.

All of these systems were however either expensive to make, or difficult to operate, or in fact unreliable in use.

This is due principally to the fact that the instruments had to be built into casings small enough to fit down relatively small diameter boreholes. Consequently the moving parts had to be made extremely small and delicate, in order to have adequate sensitivity to provide accurate readings.

Clearly, there is a need for a dip angle indicator operating on a different principle, and with a minimum of moving parts, and yet producing a high degree of accuracy in the reading of the dip angle.

BRIEF SUMMARY OF THE INVENTION

With a view therefore to achieving the foregoing advantages, the invention comprises a dip angle indicator for use in boreholes, and comprising, an elongated casing, having a diameter adapted to fit down a desired borehole, a sensing chamber, located along the central axis of the casing and defining first and second ends, a linear variable displacement transducer, located along said central axis, and having an operating rod with a free end positioned in said sensing chamber, said rod free end defining a generally conical point, a swing arm located within said sensing chamber, along said central axis, and having a free end defining a generally conical recess, said conical recess receiving said conical point of said transducer rod, movable mounting means mounting said swing at one end of said sensing chamber, remote from said transducer, said swing arm extending through said moveable mounting means outside of said chamber, and, weight means mounted on said free end of said swing arm outside said chamber, said weight means being free to move within said casing, whereby to tilt said swing arm within said chamber.

A further feature of the invention is the provision of a pressure means for said transducer urging said conical point of said rod into secure engagement with said conical recess of said swing arm.

A further feature of the invention is the provision of a conical point of said transducer rod having a predetermined cone angle, and wherein the conical recess in said swing arm has a predetermined cone angle which is greater than said cone angle of said point, whereby when said swing arm is tilted by said weight, said point of said transducer rod is able to slide along the surface of said conical recess.

It is a related feature of the invention that the sliding of the point of the transducer rod along the conical recess produces linear displacement of the transducer away from the swing arm, such linear displacement providing a signal from said transducer, said signal being proportional to said swing arm displacement and said linear displacement being proportional to the tilting of said linear arm, thereby giving a signal proportional to the dip angle of the borehole.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 4 is an enlarged section along the line 4—4 of FIG. 3;

FIG. 5 is a greatly enlarged sectional detail of the portion indicated in FIG. 4;

FIG. 6 is a view corresponding to FIG. 5, showing another position; and

DESCRIPTION OF A SPECIFIC EMBODIMENT

Figure 1:
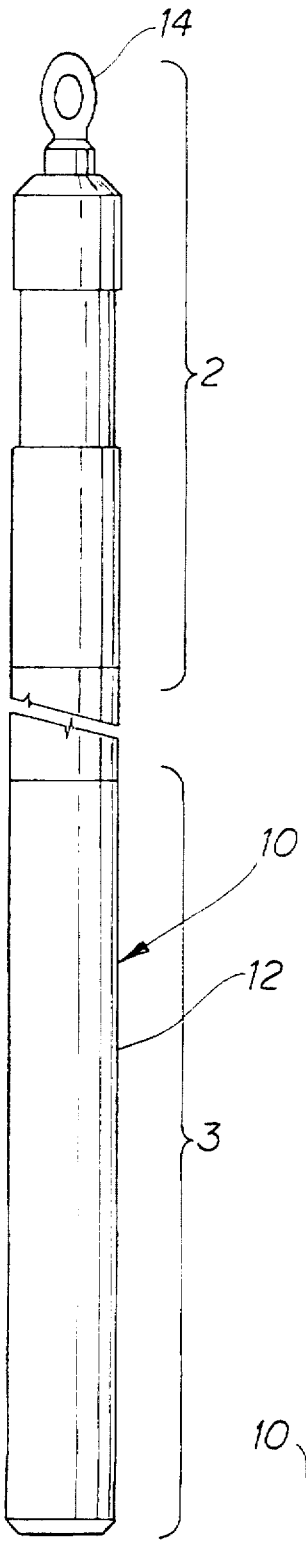
FIG. 1 is a partially cutaway elevational view of an instrument illustrating the invention.
Figure 2:
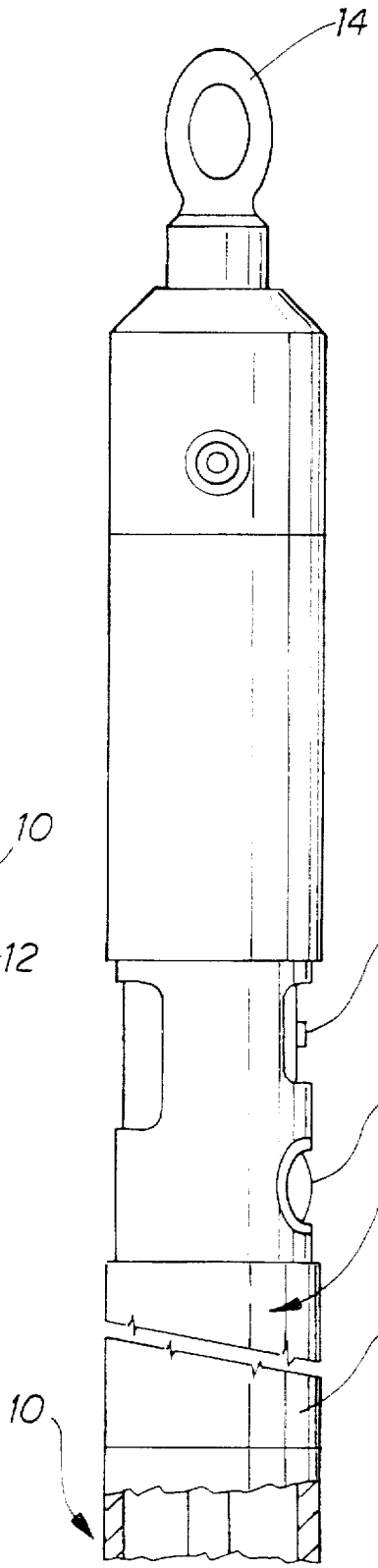
FIG. 2 is an enlarged elevation of a portion of the instrument illustrated in the bracket 2 of FIG. 1, illustrating the invention.
Figure 3:
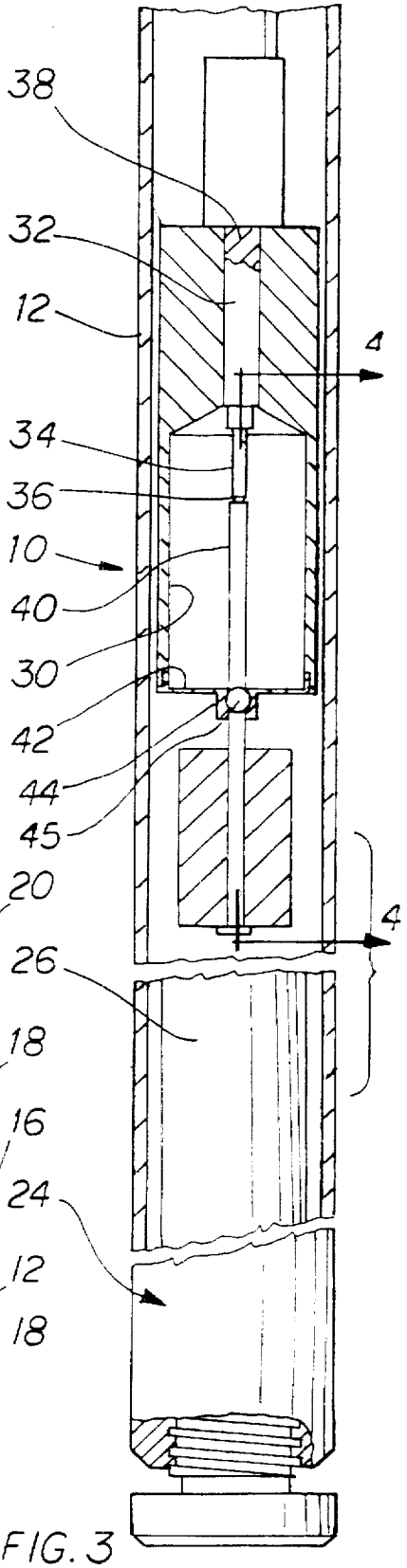
FIG. 3 is an enlarged partially sectioned elevation of another portion of the instrument in accordance with the invention, and illustrated in the bracket 3 of FIG. 1.

Referring to FIGS. 1, 2 and 3, the invention will be seen to be illustrated in the form of a borehole instrument indicated generally as 10. The instrument 10 comprises an elongated casing 12, which is dimensioned so that it can fit down a borehole liner of an appropriate diameter. The casing 12 is cylindrical in shape, and of substantially regular exterior dimension, and is usually made of metal. At the top end it will have a ring, or other attachment means indicated as 14 by means of which it may be attached to a suitable cable at the head of the borehole, to enable the instrument to be lowered down the borehole casing. Casing 12 may be considered as two portions indicated by the brackets 2 and 3 in FIG. 1. The bracket 2 indicates as shown in FIG. 2, the upper portion of the apparatus 10 will be seen to have a sliding sleeve cover 16 which is normally slid upwardly and closed, but which may be slid downwardly to take a visual reading from the readout window 18. A manual button 20 operates the display in the window 18.

Such a reading will be taken when the instrument is drawn back up to the surface, having been lowered a predetermined length by means of the cable (not shown) and then withdrawn once more.

The lower portion of the device indicated by the bracket 3 of FIG. 1, comprises a lower power source 24, containing a battery 26, and having an end cap 28 by means of which the battery may be removed and replaced. Above the battery 26 but within the casing 12, there is shown a sensing chamber 30. At the upper end of the chamber 30, there is located a linear variable displacement transducer, indicated generally as 32, having a transducer rod 34 extending therefrom. The rod 34 terminates in a downwardly directed conical point 36.

The rod 34 is displaceable against a resilient spring or buffer 38, to apply pressure to the transducer 32. The response of the transducer 32 is a linear response so that as the pressure varies, the pressure causes linear displacement movement of rod 34, against spring 38 which in turn causes the signal produced by the transducer. The signal is directly proportional to the increase or decrease in pressure, and resulting linear movement. Linear response transducers of this type are currently available from others and the details are omitted for clarity.

Also, within the sensing chamber 30, there is a swing rod 40, which is swingably mounted on a resilient bearing 42 at the lower end of chamber 30. The bearing 42 may be made of rubber, or some other resilient synthetic material, but typically will be a flexible stainless steel diaphragm. A diaphragm bearing 42 will define a collar 44 fitting snugly around the swing rod 40 secured by a screw 45. The upper end of the swing rod 40 terminates adjacent the conical point 36 of the rod 34. At its upper end, the swing rod 40 is provided with a conical recess 46 (FIGS. 5 and 6), which receives the conical point 36. The cone angle of the point 36 has a predetermined first value A, and the cone angle of the conical recess 46 has a predetermined cone angle B. The angle B is greater than the angle A.

At the centre of the conical recess 46, there is a central generally hemispherical depression or recess 48 (FIG. 6), which is shaped and designed to initially retain the point 36 in position, and prevent unnecessary erratic movements.

On the free end of swing rod 40 there is provided a mass or weight 50, which is located within casing 10, but is spaced from the inside walls thereof, so that the mass 50 can swing to and fro.

Assuming that the casing is held more or less vertical, then the mass 50 will be located along the central axis of the casing 10. When the casing 10 is lowered on a cable (not shown) down a bore hole, the casing 10 will then lie at the angle at which the bore hole casing is lying. This will then cause the mass 50, under the influence of gravity, to swing or tilt. This will then cause the swing rod 40 to swing or tilt in the opposite direction. The transducer rod 34 is then subjected to axial pressure, as the point or tip 36 of the rod 34 traverses across the surface of the conical recess 46.

It is apparent that the greater the amount of swing of the rod 40, the greater will be the amount of the linear movement of the rod 34.

Thus, the pressure applied and the movement caused to the linear transducer will vary directly as a result of the tilting angle of the swing rod 40.

This will then provide a direct electrical signal being a readout of the angle of dip of the bore hole, relative to the vertical.

By suitable circuits, this dip angle is recorded in a suitable memory, and when the casing 10 is again withdrawn to the surface, the operator can by means of the manual switch obtain a visual readout of the angle of the bore hole.

Figure 7:
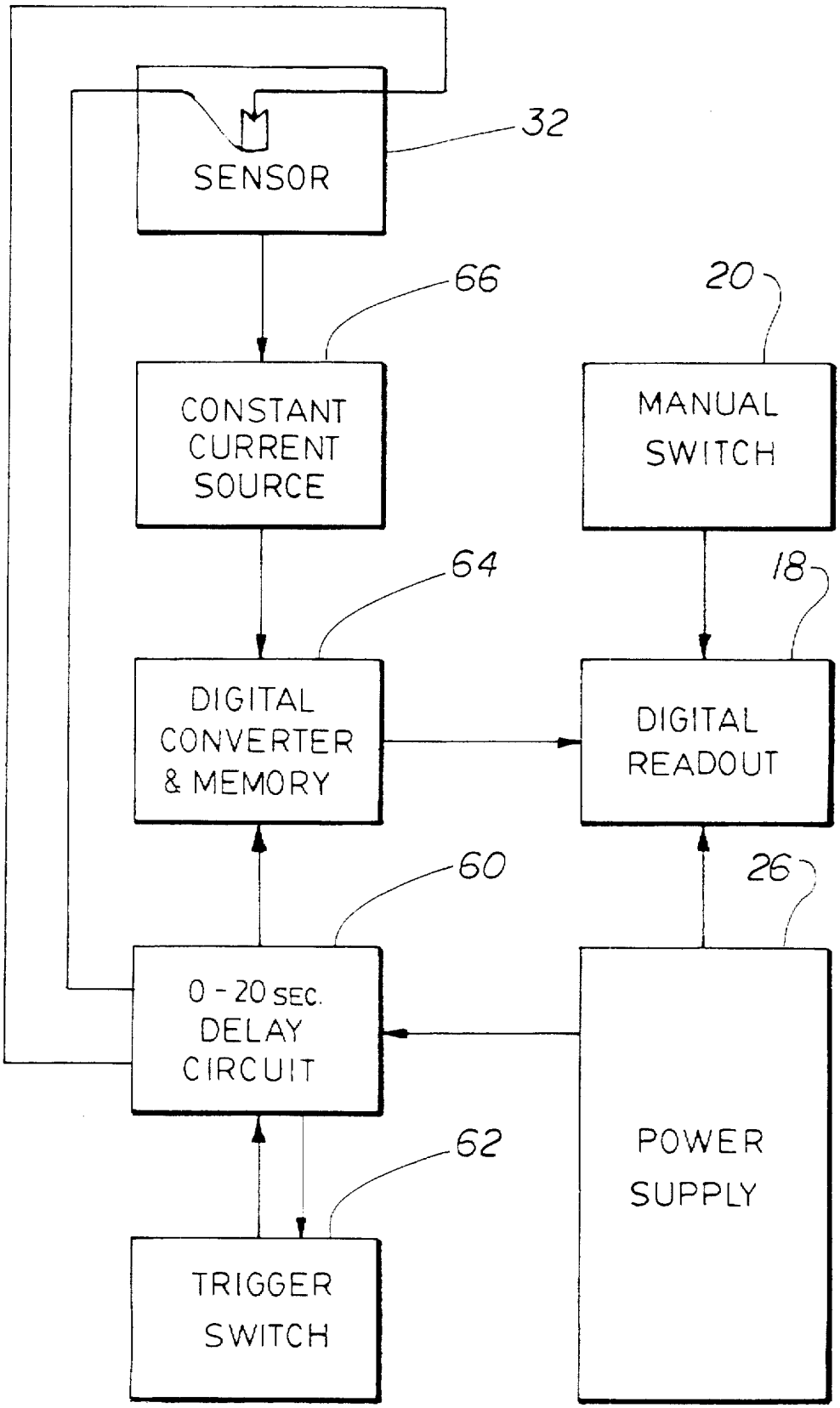
FIG. 7 is a block diagram of the electrical circuits of the instrument illustrating the invention.

One example of suitable circuitry is shown if FIG. 7.

The sensor is indicated generally by the block 32, and is connected to a delay circuit 60, which is adapted to provide power, after a predetermined delay time.

Delay circuit 60 is connected to a trigger switch 62, and to the power supply 26.

The delay circuit 60 is also connected to a digital memory 64, and a constant current source 66 is connected to the memory 64. The memory 64 is in turn connected to the readout 18, and manual switch 20.

In operation the delay circuit provides a suitable delay time, to allow the instrument to be lowered to the desired depth, and then to adopt a steady position.

After that delay, power is supplied to the sensor, which then is connected through the constant current source 66 to the digital memory 64. The signal is then stored in the memory 64 until such time as the instrument is retrieved to the surface. The manual switch 20 is then operated, and the signal can then be read in the manual readout.

The delay circuit cooperates with the trigger switch, to trigger the operation of the sensor after the appropriate delay.

It will be apparent that the device is of extreme simplicity and is virtually maintenance free since it can be built and totally sealed, the only maintenance required being the recharging of the battery.

The only moving parts are the swing rod 40, which being mounted in a flexible or diaphragm bushing 42, is relatively trouble free for an extended useful life, and the linear transducer and transducer rod 34 which simply move to and fro along a linear axis. There is virtually no wear and no lubrication required.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dip angle indicator for use in boreholes, and comprising;

an elongated casing, having a diameter adapted to fit down a desired borehole;

a sensing chamber, located along the central axis of the casing and defining first and second ends;

a linear variable displacement transducer, located along said central axis, and having an operating rod with a free end positioned in said sensing chamber, said rod free end defining a generally conical point;

a swing arm located within said sensing chamber, along said central axis, and having a free end defining a generally conical recess, said conical recess receiving said conical point of said transducer rod;

movable mounting means mounting said swing arm at one end of said sensing chamber, remote from said transducer, said swing arm extending through said moveable mounting means outside of said chamber, and, weight means mounted on said free end of said linear arm outside said chamber, said weight means being free to move within said casing, whereby to tilt said swing arm within said chamber.

2. A dip angle indicator as claimed in claim 1 including a pressure means in said transducer urging said conical point of said rod into secure engagement with said conical recess of said swing arm.

3. A dip angle indicator as claimed in claim 1 wherein said conical point of said transducer rod has a predetermined cone angle, and wherein the conical recess in said arm has a predetermined cone angle which is greater than said cone angle of said point, whereby when said swing arm is tilted by said weight, said point of said transducer rod is free to slide along the surface of said conical recess.

4. A dip angle indicator as claimed in claim 1 wherein the sliding of the point of the transducer rod along the conical recess produces linear displacement of the transducer rod away from the arm, such linear displacement providing a signal from said transducer, said signal being proportional to said linear displacement and said linear displacement being proportional to the tilting of said swing arm, thereby giving a signal proportional to the dip angle of the borehole.

5. A method of measuring a dip angle of a borehole by means of an instrument adapted to fit down a desired borehole, the instrument having a sensing chamber, a linear variable displacement transducer, located along the central axis of the chamber and having a transducer rod with a free end positioned in said sensing chamber, said rod free end defining a generally conical point, a swing arm located within said sensing chamber, along said central axis, and having a free end defining a generally conical recess, said conical recess receiving said conical point of said transducer rod, and movable mounting means mounting said swing arm at one end of said sensing chamber, remote from said transducer, said swing arm extending through said moveable mounting means outside of said chamber, and, weight means mounted on said free end of said linear arm outside said chamber, said weight means being free to move within said casing, whereby to tilt said swing arm within said chamber, and comprising the steps of;

placing said instrument in said borehole;

allowing said swing arm to swing in response to gravity acting on said weight, and causing said transducer rod to move along a linear axis and generate a signal.

6. A method of measuring a dip angle as claimed in claim 5 wherein the conical point of said transducer rod has a predetermined cone angle, and wherein the conical recess in said arm has a predetermined cone angle which is greater than said cone angle of said point, whereby when said swing arm is tilted by said weight, said point of said transducer rod slides across the surface of said conical recess, thereby forcing said transducer rod to move on a linear axis.

7. A method of measuring a dip angle indicator as claimed in claim 6 wherein the linear displacement provides a signal from said transducer, said signal being proportional to said linear displacement and said linear displacement being proportional to the tilting of said swing arm, thereby giving a signal proportional to the dip angle of the borehole.

* * * * *